United States Patent [19]

Guenther et al.

[11] 3,946,765

[45] Mar. 30, 1976

[54] MECHANISM FOR FEEDING THE SHUTTLES INTO THE WEAVING CYLINDER OF AN AUTOMATIC WAVE SHED LOOM

[75] Inventors: Ludwig Guenther; Guenter Welzel, both of Karl Marx Stadt; Rainer Janausche, Negersdorf, all of Germany

[73] Assignee: VEB Wirkmaschinenbau Karl-Marx-Stadt, Karl-Marx-Stadt, Germany

[22] Filed: Nov. 8, 1974

[21] Appl. No.: 522,072

[52] U.S. Cl. ..... 139/12; 139/126; 139/133

[51] Int. Cl.[2] ..... D03D 47/26

[58] Field of Search..... 139/12, 224 R, 125, 126 R, 139/133, 188 R, 191

[56] References Cited

UNITED STATES PATENTS

| | | | |
|---|---|---|---|
| 3,263,705 | 8/1966 | Rossmann | 139/12 |
| 3,705,606 | 12/1972 | Stucki | 139/12 |
| 3,724,508 | 4/1973 | Jekl et al. | 139/12 |
| 3,729,029 | 4/1973 | Zabrodsky et al. | 139/12 |
| 3,732,896 | 5/1973 | Jekl et al. | 139/12 |
| 3,765,458 | 10/1973 | Ziegler et al. | 139/126 |
| 3,817,291 | 6/1974 | Welzel | 139/12 |

FOREIGN PATENTS OR APPLICATIONS

| | | | |
|---|---|---|---|
| 188,389 | 12/1966 | U.S.S.R. | 139/12 |

*Primary Examiner*—James Kee Chi
*Attorney, Agent, or Firm*—Nolte and Nolte

[57] ABSTRACT

An improvement in an apparatus for feeding shuttles into a spiral groove between nose-like projections of driving hooks on a weave cylinder in an automatic wave shed loom which apparatus has a feeding apparatus comprising a conveyor means for inserting the shuttles into the spiral groove, the improvement comprising a plurality of vertically disposed drive pins on said conveyor means which pins engage said shuttles positively and move them into said spiral groove.

8 Claims, 13 Drawing Figures

MECHANISM FOR FEEDING THE SHUTTLES INTO THE WEAVING CYLINDER OF AN AUTOMATIC WAVE SHED LOOM

BACKGROUND OF THE INVENTION

This invention relates to a feeding mechanism whereby shuttles in an automatic wave or progressive shed loom are positively fed into the spiral groove between nose-like projections of driving hooks on a weaving cylinder of an automatic wave shed loom. The apparatus of the present invention is directed to a positive insertion of the shuttles by means of a conveyor and driving pins into the spiral grooves between the nose-type projections of the driving hooks.

Automatic wave shed looms have been known. In these automatic wave shed looms, the movement of the shuttle into and out of the progressive sheds is effected by means for beating up the weft threads. This means has recesses therein which are responsible for releasing the temporarily guided shuttles. When the shuttle enters the sheds, it is released immediately above the groove of the beating up means formed by the driving hooks. After the shuttles have passed through the sheds formed, they are pushed by driving hooks of the beating up means into the recesses of the return drum. As soon as the return drum has performed a revolution up to the return device, the shuttles held in the recesses are released by loosening a pawl. The return device moves the shuttles into the recesses of the feed drum and after winding with weft thread of predetermined length, the shuttles are fed to the beating up means as described above and the cycle is closed.

It is already been proposed to effect the feeding of the shuttles into the sheds formed by means of a conveyor shaft with a rectangular spiral and a guide partly embracing the latter. The guide has recesses through which the shuttles can be fed.

While such a mechanism can work, it suffers from the disadvantage that in the use of the pawls, a specific control is required. If the pawl is not released at the exact, correct moment of time, the driving hooks can be destroyed and the shuttles can be damaged. The free fall movement can lead to the canting of the shuttle which can likewise cause breaks. These problems can only be eliminated by complicated and expensive apparatus and by extreme care in the use thereof.

The proposed feeding method for shuttles employing a revolving conveyor worm suffers from the disadvantage that it does not positively push the shuttles completely into the groove of the beating up means formed by the nose-type projections. This is due to the fact that the conveyor worm requires a separate support between the beating up means and the end of the conveyor worm. This support in turn requires a certain space which forms practically an interval between the beating up means and the conveyor worm. In this interval, there is a complete absence of a pushing action on the shuttles. At the high revolving speeds, the shuttles are pushed into the groove of the beating up means only by their inherent kinetic energy. The end position of the shuttles in the groove can thus not be exactly predetermined. There may be shocks when the shuttles slide farther to the front and the nose-type projections of the driving hooks follow somewhat later. Finally, an exactly predetermined positon of the shuttle of the head of the beating up means is necessary to insure a positive grip of the freely protruding weft end.

It, therefore, became desirable to provide a feeding apparatus for an automatic progressive shed loom whereby the shuttle would be positively fed into the spiral grooves defined by the nose-like projections of the driving hooks of a beating up means. Moreover, it became desirable to provide such an apparatus which would avoid shocks and breaks in the feeding of the shuttles into the beating up means. It became particularly desirable to provide for such an apparatus whereby the shuttle could be positively fed into the spiral grooves by a simple conveyor means which did not require the elaborate construction which apparatus avoids creation of an interval between a beating up means and a conveyor.

SUMMARY OF THE INVENTION

In accordance with the present invention, there is provided an improved feeding mechanism for an automatic progressive shed loom. The present invention is therefor directed to an improvement in a feeding apparatus for automatic wave shed loom, which loom has a beating up means, shuttles, means for feeding weft yarn to said shuttles, which feeding apparatus comprises a conveyor means for inserting said shuttles into a spiral groove between nose-like projections of driving hooks in the form of discs comprising the beating up means, the improvement being for positively feeding shuttles into said grooves which improvement resides in that the conveyor means carries a plurality of vertically disposed drive pins which drive pins positively engage said shuttles and move them into said spiral groove.

In accordance with the present invention, there is provided a conveyor which generally consists of an endless horizontally disposed revolving conveyor chain which conveyor chain carries driving pins, each of which driving pins can positively engage a side of the shuttle and move said shuttle positively into a spiral groove. The present invention generally has a pair of sprocket wheels about which there is an endless sprocket chain. Means are provided, as more fully discussed below, to drive the sprocket wheels. The sprocket wheels have links joined together by vertically disposed link pins. The axis of the vertically disposed link pins is substantially coaxial with the vertical axis of the driving pins which are carried by the endless sprocket chain. The driving pins are connected to the chain through an elastic mounting. This can be accomplished by providing a generally U-shaped receiver on the chain which U-shaped receiver carries an elastic molded body which in turn carries, in pendant fashion, the vertically disposed drive pins. The U-shaped receiver is generally horizontally disposed.

A particularly desirable feature of the invention involves the use of shuttles which have a beveled side. The drive pins carried on the sprocket wheel engage the beveled side of the shuttles. During the movement between the sprocket wheels, the shuttle is positively engaged by the pins. As the pin is caused to revolve about the sprocket wheel at the return position of the chain, the pin gradually moves down the bevel on the shuttle and breaks away at the precise moment. No undue shocks or the like are encountered. In such a mechanism, therefore, from the operating station the point of action of the drive pin on the bevel of the shuttle is ahead of the first point of action formed by the beating up means. Similarly, as viewed from the beating up means in the feeding direction, the point of action of the drivng pin is ahead of the point of action of the beating up means.

In certain refinements of the invention, the drive pins are carried by the sprocket chain which has the aforementioned elastic molded body disposed there between. The elastic molded body has a specific shape in the form of generally back-to-back horizontally running U-shaped recesses. By use of these U-shaped recesses, the pins are moved precisely owing to the fact that in the region of the sprocket wheels, i.e., in the return region, the recesses are partially accommodated with facing guiding rails. Similarly, in the region of the reversing mechanism, i.e., at the sprocket wheel, there can also be a guide plate for guiding the pins disposed therebeneath.

BRIEF DESCRIPTION OF DRAWINGS

The present invention can be more readily understood and appreciated when reference is made to the accompanying drawings in which.

DESCRIPTION OF THE SPECIFIC EMBODIMENT

Figure 1:
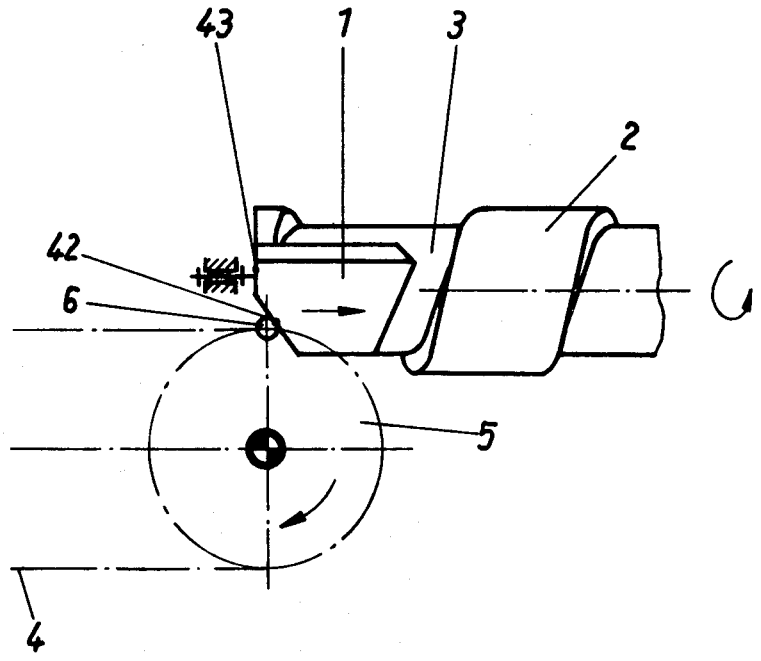
FIG. 1 shows a principle diagram of the feeding mechanism of the present invention in plan view.

The specific embodiment of the present invention is shown in the drawings. Referring to FIG. 1, the shuttles 1 pick the weft yarn by means of the beating up means 2 into the wavy progressive sheds of the automatic progressive shed loom. The beating up means 2, shown in FIG. 1 in a simplified form, has a groove 3 which extends spirally over the entire length of the beating up means 2. An endless conveyor chain 4 runs about a chain wheel 5 and carries a driving pin. By means of this driving pin 6, the shuttles 1 are completely pushed into the groove 3 of the beating up means 2. This is an important feature of the present invention whereby the shuttles are positively inserted into the spiral groove.

Figure 2:
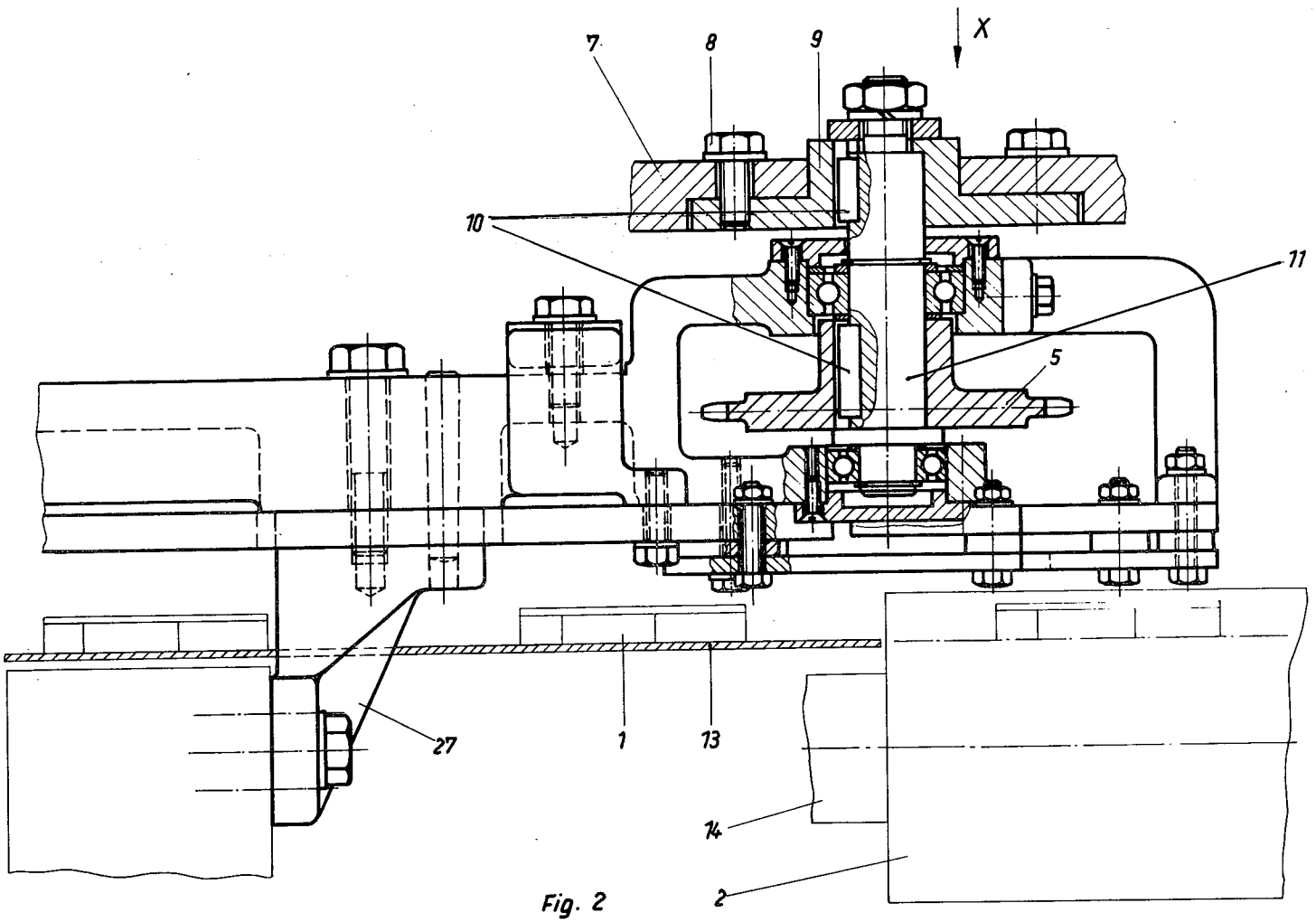
FIG. 2 shows a partial section of a side elevation of the right side of the feeding mechanism with driving gear.
Figure 6:
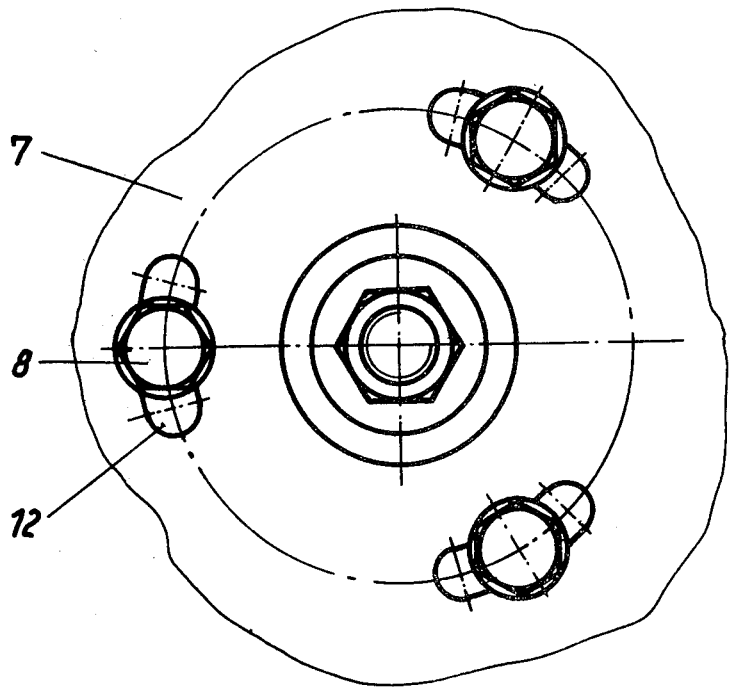
FIG. 6 shows a view in the direction X of FIG. 2 in the range of the driving gear.

As can be seen from FIG. 2, the sprocket wheel 5 is set in revolution by a driving gear. This driving gear which is part of the driving means for the sprocket wheels comprises a pinion 7, which is connected by means of screws 8 with a flange 9. This flange 9, and also the sprocket wheel 5, is rotatably connected with the drive shaft 11 by means of adjusting springs 10. As can be seen from FIG. 6, oblong slots 12 are provided in the pinion 7. Thus, the pinion has an oblong slot therein and is connected by a screw through the slot to the flange 9, the flange 9 in turn being connected to a drive shaft, the drive shaft in turn being connected to one of the sprocket wheels, i.e., sprocket wheel 5. By loosening the screw 8, the pinion 7 can be adjusted relative to the flange 9. Thus, one can effect an infinite adjustment of the feeding position to the phase position of the beating up means 2.

Figure 3:
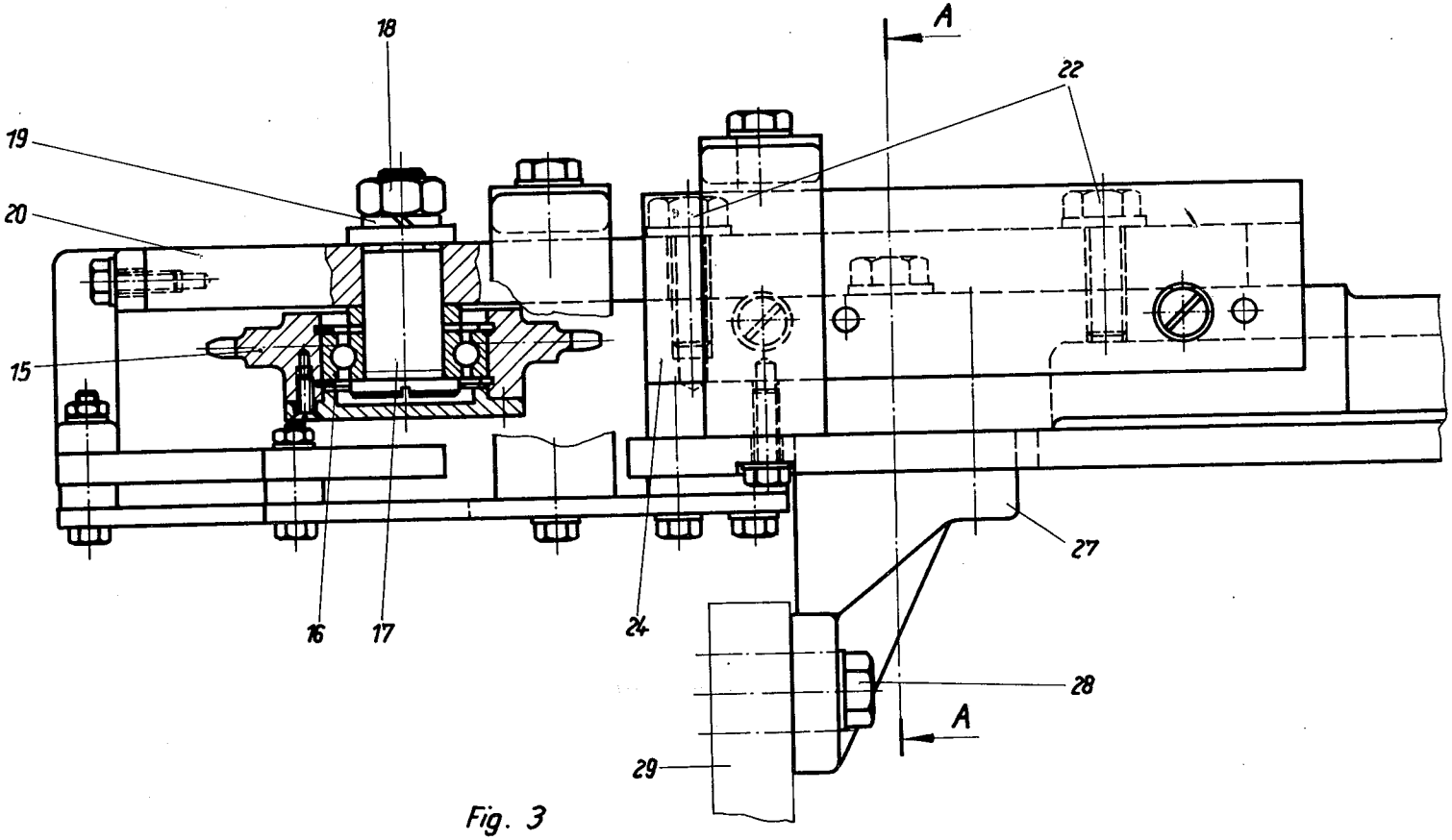
FIG. 3 shows in a partial section a side elevation of the left side of the feeding mechanism which mechanism is provided with a chain tightener.
Figure 8:
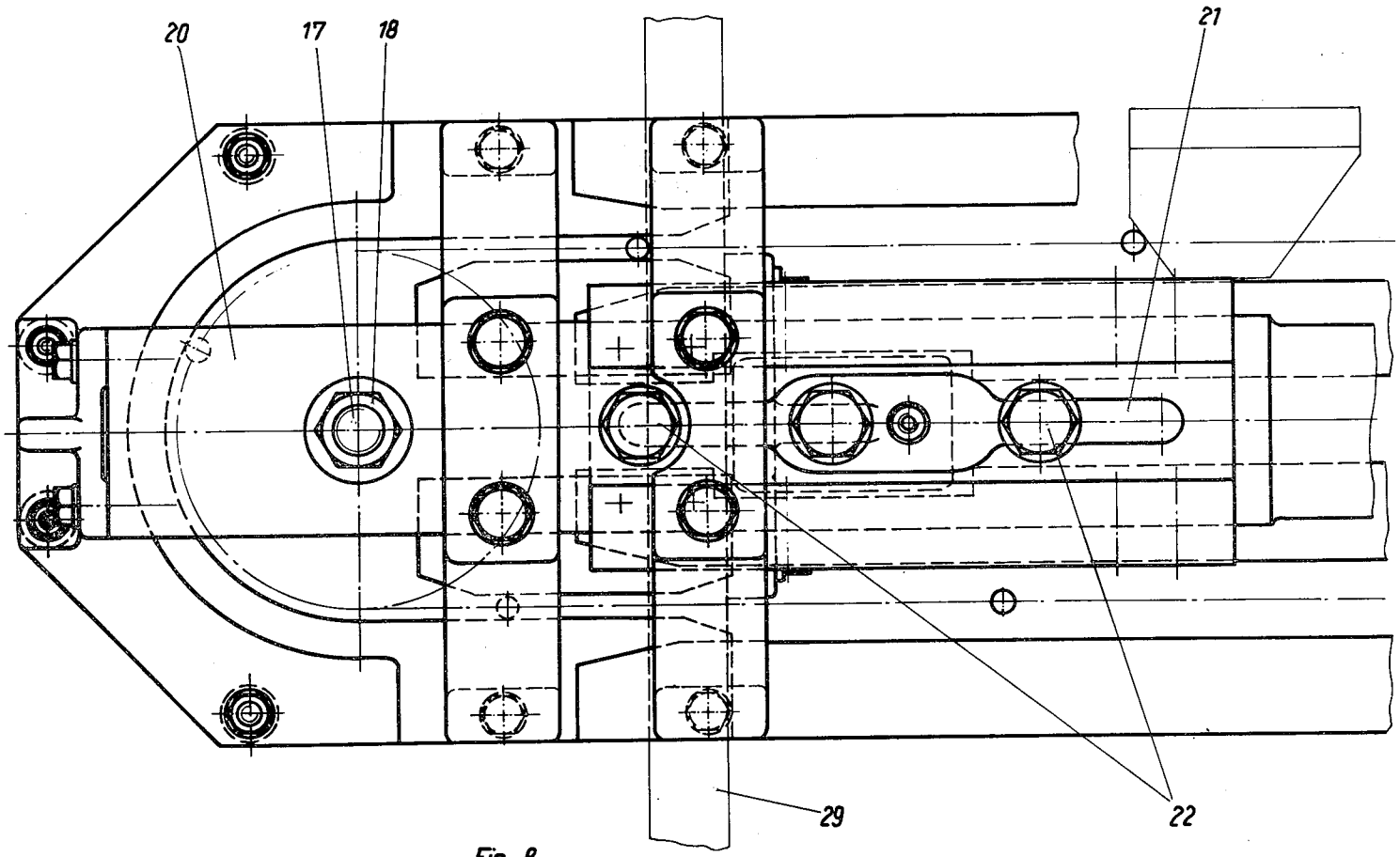
FIG. 8 shows a top view of FIG. 3.
Figure 12:
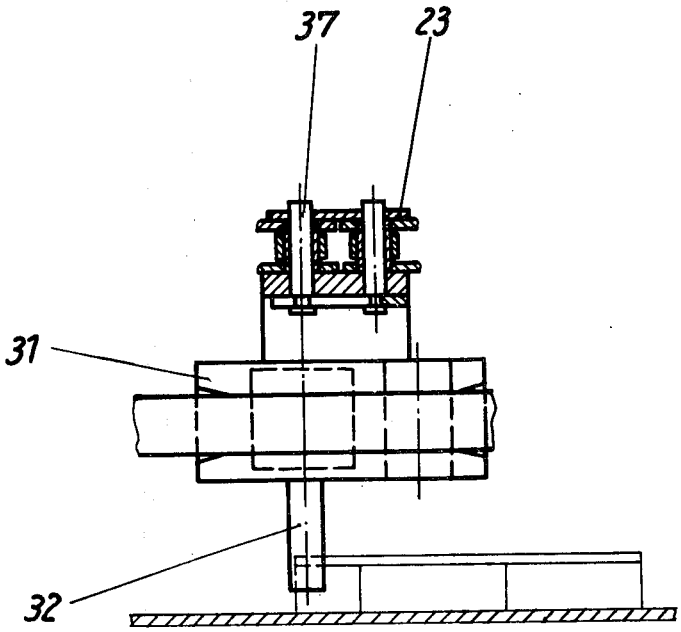
FIG. 12 shows in a partial section a front view of the center of the feeding mechanism.
Figure 13:
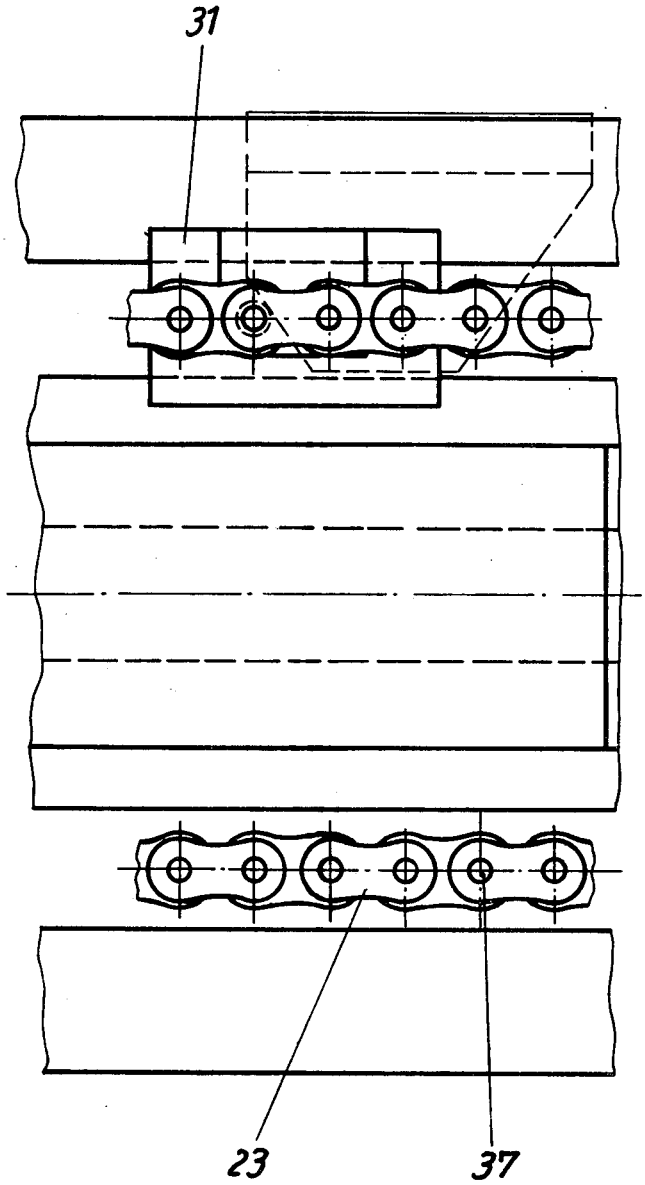
FIG. 13 shows a top view of FIG. 12.

In the lower portion of FIG. 2, there can be seen that the shuttles 1 on their slideway 13. The beating up means 2 with its drive shaft 14 can likewise be seen. The opposite left side of the feeding mechanism is shown in FIG. 3. There, a second sprocket wheel 15, which cooperates with the sprocket wheel 5, is mounted rotatably about a ball bearing 16 and a bolt 17. The bolt 17 has at its end a thread and is secured by means of a nut 18 and a tension ring 19 on the chain tightener 20. This chain tightener 20 has an oblong slot 21, as can be seen from FIG. 8. By loosening the screws 22 fastened to fixed support 25, the upper surface of which provides a bearing for chain tensioner 20, the chain tensioner 20 can be displaced, with mounting 24. Thus, one can loosen or tighten the chain 23, i.e., chain 4, (FIGS. 12 and 13) by suitable adjustment of the chain tightener 20 using loosening screws 22. This is seen by way of example in FIG. 13.

The two screws 22 are secured in a stationary girder 25. As it can be seen from FIG. 4, the girder 25 is surrounded in the range of the chain 23 by a housing 26. The girder 25 is rigidly connected with the machine frame 29 by means of a bracket 27 and screws 28.

Figure 4:
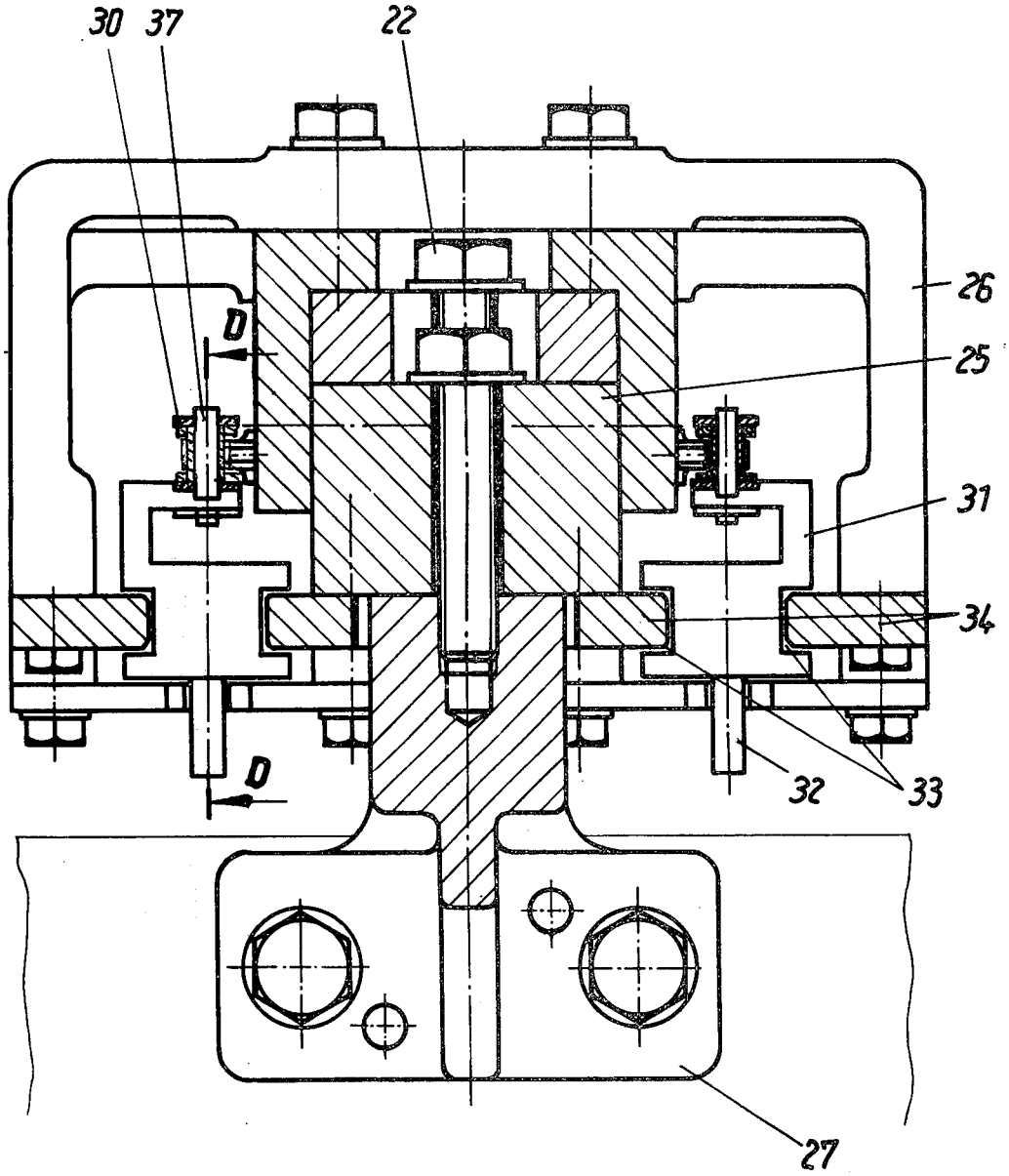
FIG. 4 shows a section along A—A of FIG. 3.
Figure 5:
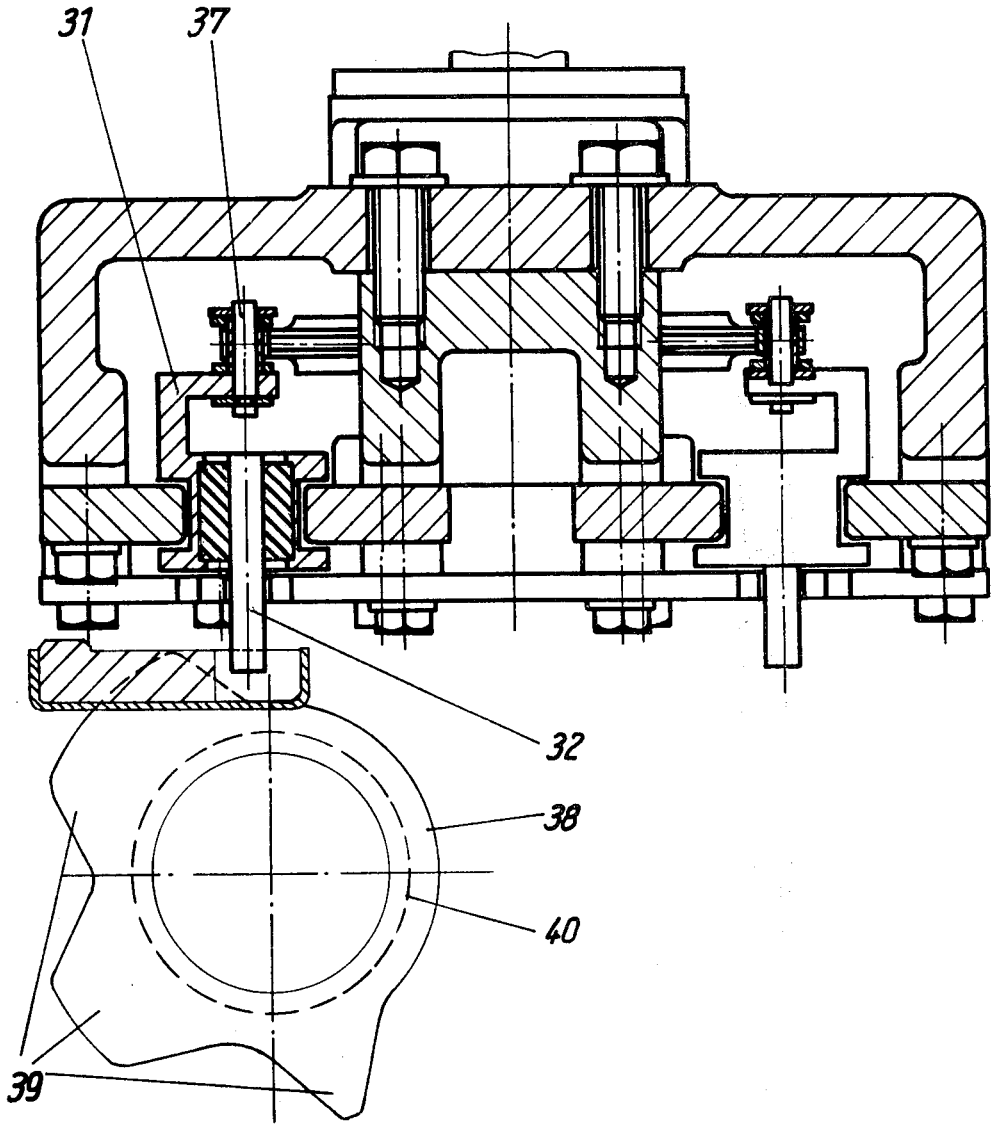
FIG. 5 shows a section along line B—B of FIG. 7.
Figure 10:
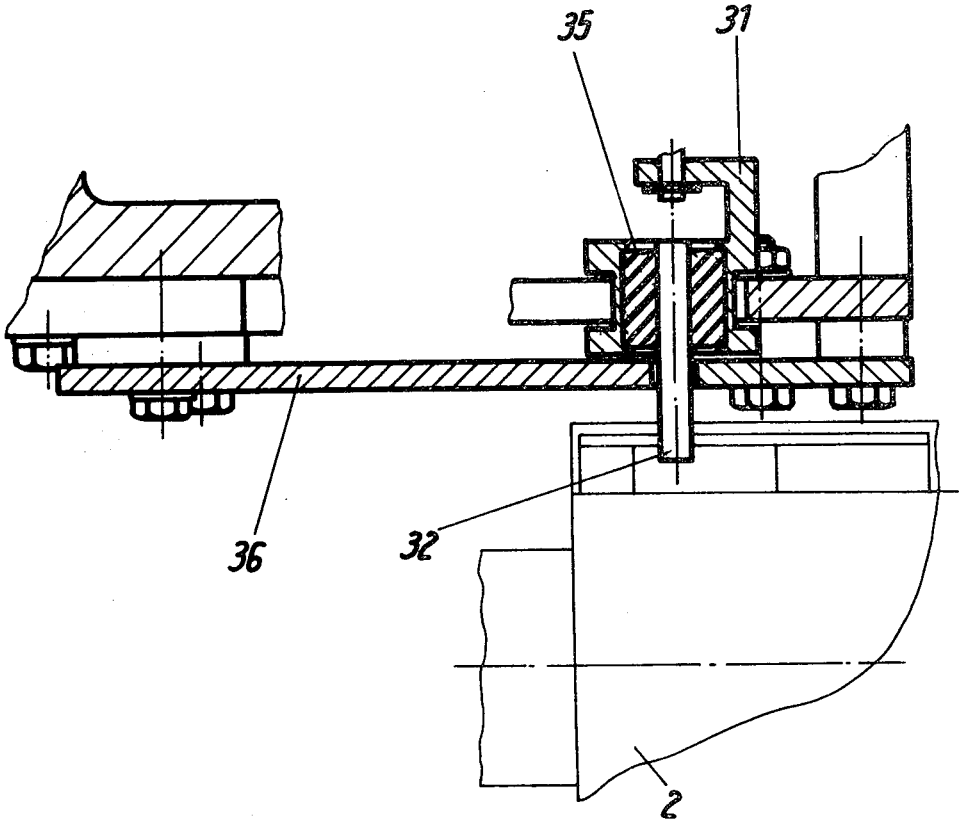
FIG. 10 shows a section along the line E—E, where the driving pins are shown turned by 53°.
Figure 11:
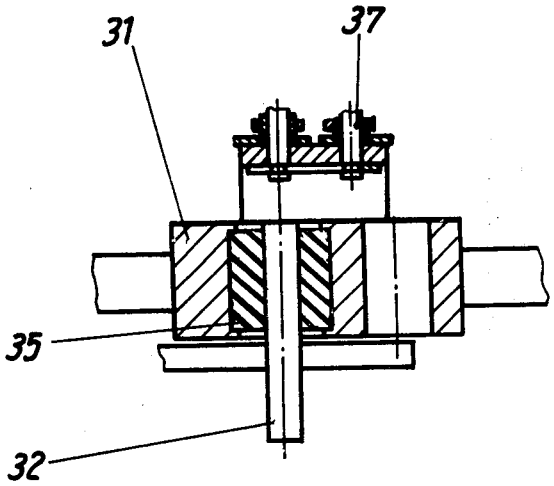
FIG. 11 shows a section along the line D—D of FIG. 4.

On the chain link 30, there is secured a receiver 31 (FIG. 4) which receiver is in the form of a horizontally disposed generally U-shaped member. The receiver 31 carries a driving pin 32. The receiver 31 with a driving pin 32 has two opposite recesses 33 in the form of back-to-back generally U-shaped recesses on either side of an elastically molded part described below. In these opposite recesses 33, there are guide rails 34 which guide the receiver 31 non-pivotally. In the center of the receiver 31, there is provided the aforenoted elastic molded body 35 by which the driving pin 32 is held elastically as seen in FIG. 11. Both guide rails 34 are provided at the opposite reversing points of the feeding mechanism. In the range of the reversal, i.e., at the ends of the chain where the chain goes about the outwardly disposed periphery of the sprocket wheels 5 and 15, there are provided guide plates 36 so that as to guide the driving pins 32. This improves the guidance. This configuration can be shown in FIG. 10. The design of the receiver 31 is so selected that the pins 37 of the chain 23 are arranged directly above the driving pin 32 as seen in FIG. 4. By such a provision, there is assured that the speed of travel of the driving pins 32 will be the same as the speed of travel of the link pins 37 of the chain 23.

Figure 9:
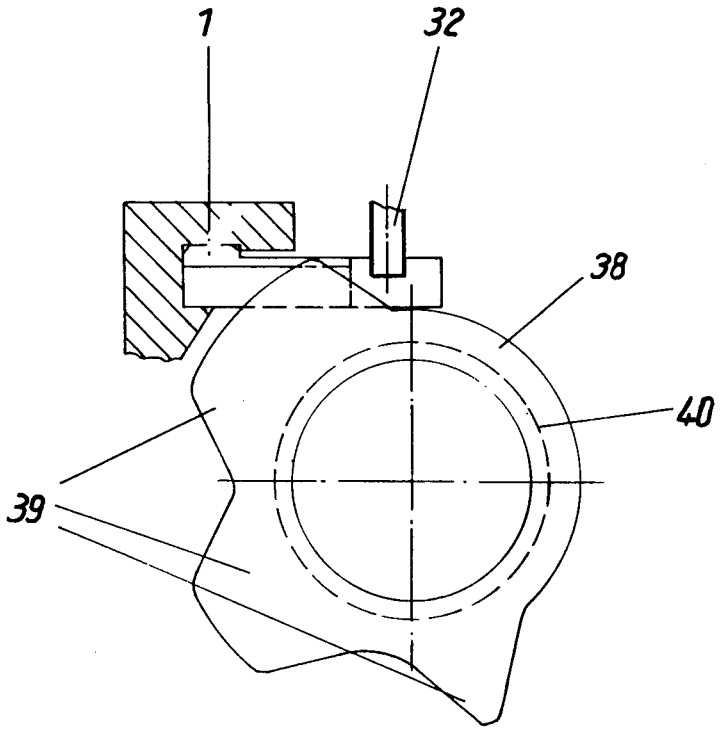
FIG. 9 shows a section along the line C—C of FIG. 7 without the longitudinal guides.

The beating up means 2 is formed of a plurality of discs in the form of driving hooks 38 with nose-type projections 39, between which are provided spacing discs 40. The discs are arranged on an axis of rotation side by side with the projections thereof progressively out of phase from one disc to the next so as to define a spiral groove between the projections. As can be seen from FIG. 9, the nose-type projections 39 of the driving hooks 38 exert a pushing action on the shuttles 1. This is done in the range of the beating up means 2. But before the shuttles 1 arrive in the beating up means 2, a winding device (not shown) serves to fill the disc or spool (also not shown) in the shuttle 1 with weft yarn. From this winding device, the shuttles 1 arrive on the slideway 13 and are inserted only by the driving pins 32 into the groove 3 of the beating up means 2.

Figure 7:
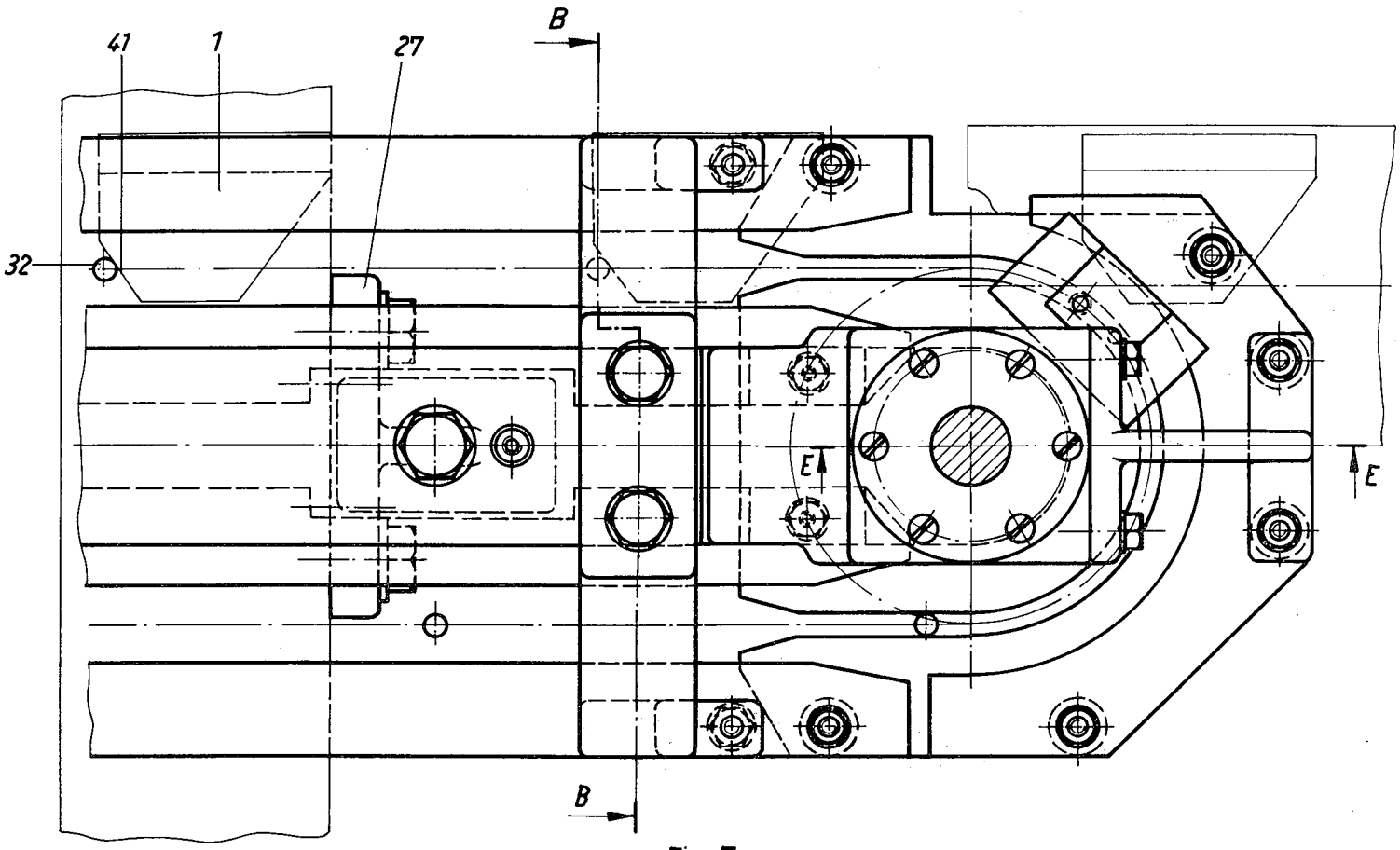
FIG. 7 shows a top view of FIG. 2.

As can be seen from FIGS. 1 and 7, the driving pin 32 acts displacing on a bevel of shuttle 1 inclined in the feeding direction. As also can be seen from FIG. 1, the point of action 42 of the driving pin 32 on the bevel 41 of the shuttle, seen from the operating station, is ahead of the point of action 43 formed by the beating up means. Seen from the beating up means 2 in the feeding direction of the shuttle 1, the point of action 42 is ahead of the point of action 43. This has the great advantage that the shuttles 1 are inserted positively and completely into the groove 3 of the beating up means 2. Since the longitudinal axis of the driving pin 32 substantially coincides in a coaxial manner with the longitudinal axis of the link pins 37 of the chain 23, the centers of the two pins, i.e., driving pins 32 and link pins 37, have the same circumferential speed during the rotation.

During the insertion of the shuttles 1 into the groove 3 of the beating up means, the driving speed is substantially reduced by the driving pin 32 on the shuttle 1. The driving pin 32 slides automatically out of range of the beating up means 2, so that an additional control with a displacement or rotation of the driving pin 32 is not necessary. Depending on the position of the sprocket wheel 5, the shuttles can be inserted more or less into the groove 3 of the beating up means.

It is apparent from the above that the invention solves the problem of the positive insertion of the shuttles into the spiral groove in a simple and efficient manner. Moreover, care is provided by the described apparatus for ensuring that no unnecessary space or time interval is involved. The driving pins act in a positive manner against the beveled side of the shuttles and ensure that without any irregular movement in the apparatus, the same are positively and completely inserted into the spiral grooves. From the description, it is apparent that the apparatus of the present invention can be constructed with readily available parts and can be readily maintained. By suitable regulating means such as the elongated slot 12 and the chain tightening means 20, the apparatus can be modified for any specific looming, weaving operation. Other advantages will be apparent to one of skill in this art.

What is claimed is:

1. In an automatic progressive shed loom, comprising a plurality of shuttles, each having an inclined trailing edge, and means for beating up the weft threads and propelling the shuttles through the sheds, the beating up and driving means comprising a plurality of discs arranged on an axis of rotation side by side and each having a plurality of projections for driving the shuttles, the discs being arranged with the projections thereof progressively out of phase from one disc to the next so as to define a spiral groove between the projections, the improvement comprising means for inserting the shuttles into the groove, the inserting means comprising an endless conveyor, a plurality of driving pins mounted on the conveyor and means for guiding the conveyor in a straight path substantially parallel to the axis of said discs to an entry end of said groove and then guiding the conveyor through a path which substantially reverses the direction of the conveyor, the inclined trailing edge of each shuttle being engaged by one of said pins while the conveyor is moving toward the entry end of said groove, the conveyor being so positioned relative to the entry end of said groove and the direction of the inclination of the trailing edge of the shuttle being opposite the inclination of the groove so that as the shuttle enters the groove the pin engages said trailing edge of the shuttle at a point on the trailing edge located forward of the entry end of said groove.

2. A loom according to claim 1, wherein said conveyor and conveyor guiding means comprise a pair of sprocket wheels, an endless sprocket chain disposed about said wheels and means for driving said wheels.

3. A loom according to claim 2, wherein said sprocket chain has links joined together by vertically disposed link pins, the vertical axis of said link pins being substantially coaxial with the vertical axis of said driving pins carried by said endless sprocket chain.

4. A loom according to claim 2, wherein said driving pins are connected to said chain through an elastic mounting.

5. A loom according to claim 4 wherein to said chain there is attached a generally horizontally disposed U-shaped receiver which carries an elastic molded body, which in turn carries dependent therefrom said vertically disposed drive pins.

6. A loom according to claim 5, wherein said molded body has two generally back-to-back U-shaped recesses which recesses are partially accommodated in the region about said sprocket wheels with facing guide rails.

7. A loom according to claim 6, wherein said drive pins are guided in the region of the sprocket wheels through a guide plate.

8. A loom according to claim 2, wherein said means for driving said sprocket wheels comprises a pinion having an oblong slot therein and connected by a screw through said slot to a flange, said flange connected to said drive shaft, said drive shaft connected to one of said sprocket wheels.

* * * * *